US010249159B2

(12) United States Patent
Guerzoni

(10) Patent No.: US 10,249,159 B2
(45) Date of Patent: Apr. 2, 2019

(54) SURVEILLANCE METHOD AND SYSTEM

(71) Applicants: Filippo Guerzoni, Modena (IT); Cesare Micheli, Parma (IT)

(72) Inventor: Filippo Guerzoni, Modena (IT)

(73) Assignees: Filippo Guerzoni, Modena (IT); Cesare Micheli, Parma (IT)

( * ) Notice: Subject to any disclaimer, the term of this patent is extended or adjusted under 35 U.S.C. 154(b) by 35 days.

(21) Appl. No.: 15/529,251

(22) PCT Filed: Nov. 30, 2015

(86) PCT No.: PCT/IB2015/059210

§ 371 (c)(1),
(2) Date: May 24, 2017

(87) PCT Pub. No.: WO2016/088018

PCT Pub. Date: Jun. 9, 2016

(65) Prior Publication Data

US 2017/0263089 A1 Sep. 14, 2017

(30) Foreign Application Priority Data

Dec. 3, 2014 (IT) ..... BO2014A0684

(51) Int. Cl.
*G08B 13/19* (2006.01)
*G08B 13/196* (2006.01)

(52) U.S. Cl.
CPC . *G08B 13/19663* (2013.01); *G08B 13/19602* (2013.01); *G08B 13/19656* (2013.01); *G08B 13/19697* (2013.01)

(58) Field of Classification Search
CPC ..... G08B 13/19663; G08B 13/19652; G08B 13/19697
See application file for complete search history.

(56) References Cited

U.S. PATENT DOCUMENTS 6,057,764 A * 5/2000 Williams ..... G07C 9/00111 340/10.42
2007/0050637 A1 3/2007 Arai et al.
(Continued)

FOREIGN PATENT DOCUMENTS

DE 102008005177 A1 12/2008
EP 2506230 A1 10/2012
FR 2964518 A1 3/2012

OTHER PUBLICATIONS

International Search Report dated Feb. 3, 2016 from counterpart PCT App No. PCT/IB2015/059210.

*Primary Examiner* — Curtis B Odom
(74) *Attorney, Agent, or Firm* — Shuttleworth & Ingersoll, PLC; Timothy Klima

(57) ABSTRACT

A method for surveillance of a predetermined region includes: —a) preparing at least one surveillance device provided with a sensor configured to detect moving entities in a predetermined region under surveillance; —b) preparing at least one remote control device which can be carried by a user; —c) detecting a moving entity in the predetermined region under surveillance, via the surveillance device; —d) sending, by the surveillance device, a request for authorization; —e) responding, by the remote control device, to the request for authorization by sending authorization data; —f) comparing the authorization data with check data for authorizing the entity detected if the result of the check is positive; —g) making available an alarm signal if the result of the check is negative or inhibiting the alarm signal if the result of the check is positive.

14 Claims, 3 Drawing Sheets

(56) References Cited

U.S. PATENT DOCUMENTS

| | | | | |
|---|---|---|---|---|
| 2009/0146817 | A1 | 6/2009 | Ikeda | |
| 2014/0139678 | A1 | 5/2014 | Moriarty et al. | |
| 2015/0119071 | A1* | 4/2015 | Basha ..... | G01S 1/68<br>455/456.1 |

* cited by examiner

SURVEILLANCE METHOD AND SYSTEM

This application is the National Phase of International Application PCT/IB2015/059210 filed Nov. 30, 2015 which designated the U.S.

This application claims priority to Italian Patent Application No. BO2014A000684 filed Dec. 3, 2014, which application is incorporated by reference herein.

TECHNICAL FIELD

This invention relates to a method and a system for the surveillance of a predetermined volume of space or area (both inside and outside buildings).

BACKGROUND ART

Known in the sector in question are surveillance systems which allow monitoring of predetermined areas.

These surveillance systems are usually equipped with sensors of various kinds (perimeter, volumetric, cameras) which allow monitoring accesses to a building (for example, doors, windows, etc.).

A first disadvantage of security/surveillance systems of this kind is due to the fact that they have a limited possibility of discriminating whether the person accessing the volume of space under surveillance is authorized to do so or not.

That means such systems are, generally speaking, activated only when there is no one in the protected area and they must be switched off when someone enters the protected area. If not switched off, such systems can set off numerous "false alarms", that is to say, unwanted alarm signals unrelated to situations of real intrusion or of potential danger.

A long-standing and particularly strongly felt need is that of having a security/surveillance system which can be left on even if there are people inside the area under surveillance, thus guaranteeing greater security for the occupants of the area.

Another need felt by users is that of having a security/surveillance system which is particularly simple.

Another need felt particularly strongly by users is that of having a security system which very easily recognizes entry of an authorized person in the area under surveillance when the security system is on and without requiring any manual intervention or operation to avoid triggering an alarm.

DISCLOSURE OF THE INVENTION

The aim of this invention is therefore to overcome these disadvantages and to meet the above mentioned needs by providing a method and a system for the surveillance of a predetermined volume of space (both inside and outside a building) and which can discriminate particularly easily and substantially automatically whether or not the person accessing the volume of space under surveillance is a person authorized to enter the region under surveillance.

According to the invention, this aim is achieved by a method and a system comprising the technical features described in one or more of the appended claims.

BRIEF DESCRIPTION OF THE DRAWINGS

The technical features of the invention, with reference to the above aims, are clearly described in the appended claims and its advantages are more apparent from the detailed description which follows, with reference to the accompanying drawings which illustrate a preferred, non-limiting example embodiment of the invention and in which:

DETAILED DESCRIPTION OF PREFERRED EMBODIMENTS OF THE INVENTION

Figure 1:
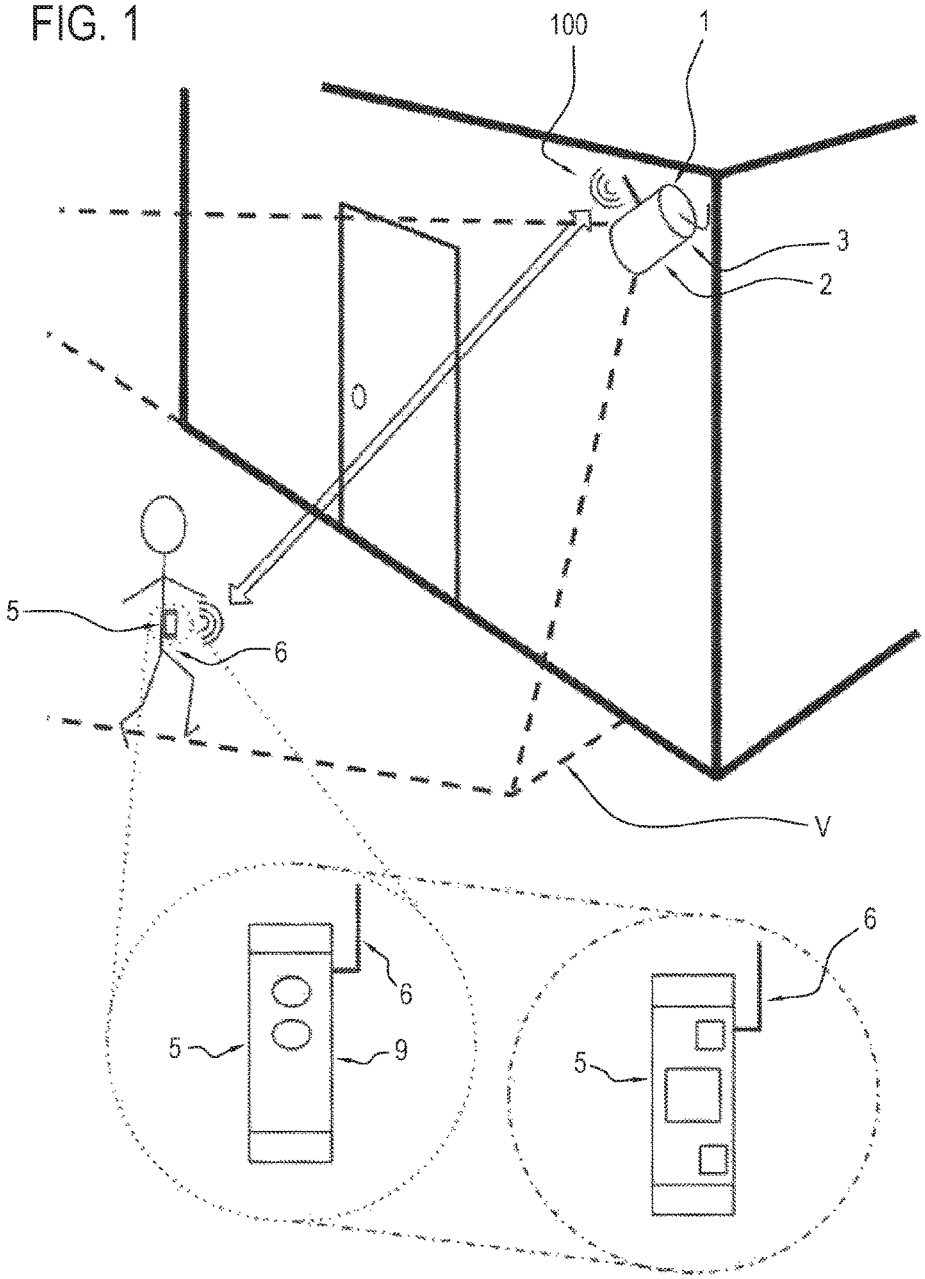
FIG. 1 illustrates a room monitored by the surveillance system according to the invention and where there is a person entering the protected volume of space.
Figure 2A:
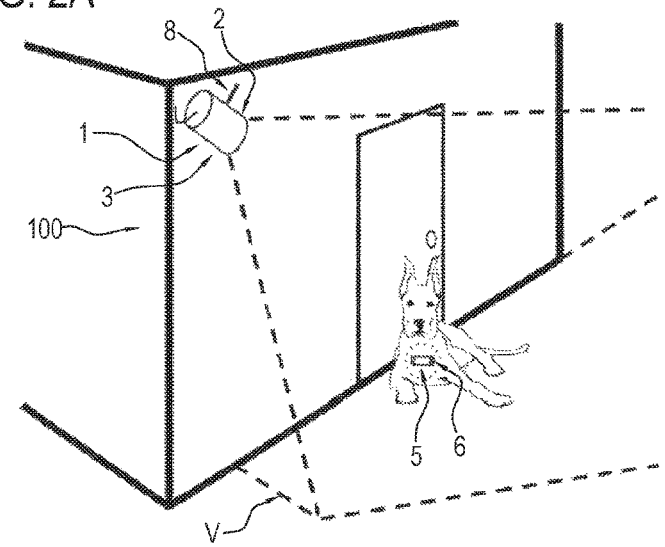
FIG. 2A illustrates a room monitored by the surveillance system according to the invention, where there is an immobile animal inside the protected volume of space.
Figure 2B:
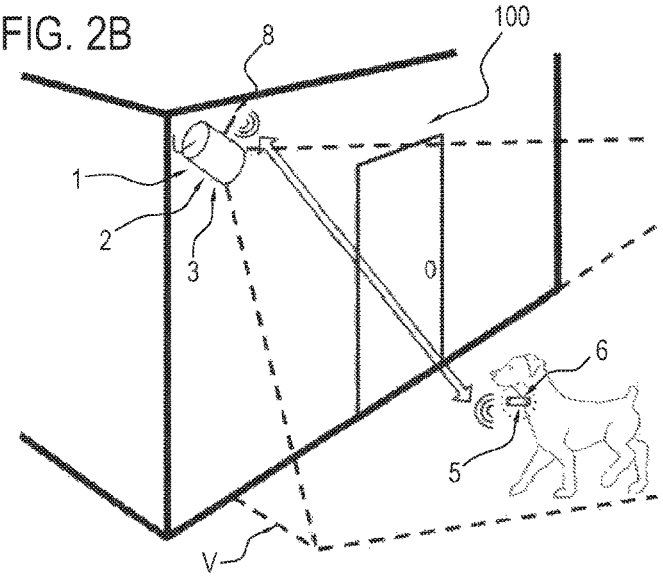
FIG. 2B illustrates a room monitored by the surveillance system according to the invention, where there is an animal in motion inside the protected volume of space.
Figure 3:
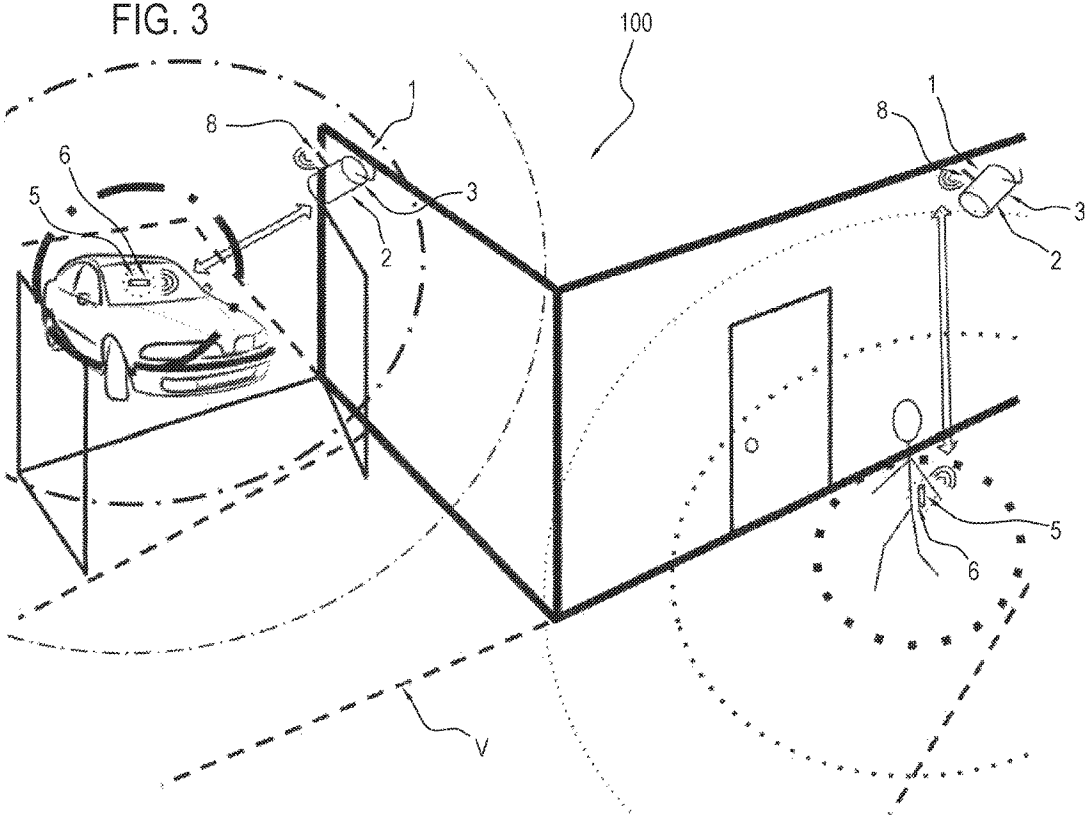
FIG. 3 illustrates a room monitored by the surveillance system according to the invention, where there are two sensors which detect simultaneous access by a person on foot and a person inside a car, where the distances (circle radiuses) between each person and the respective sensor and the intensity of the fields are shown.

According to the invention, a system 100 for surveillance of a predetermined zone (two-dimensional, one-dimensional or three-dimensional) is defined.

The surveillance system 100 comprises at least one surveillance device 1 provided with a sensor 2 configured to detect (moving) entities in a predetermined region V under surveillance, and also provided with processing means 3.

It should be noted that the expression "moving entities" is used to mean any entities entering, leaving or moving within, the region under surveillance, without any distinction between vehicles, persons, animals and inanimate entities (for example, a ball).

Preferably, the system 100 comprises a plurality of devices 1, each adapted to monitor a predetermined zone V.

It should be noted that the sensor 2 may advantageously be a sensor of any kind (camera, volumetric, perimeter, etc.).

Preferably, the sensor 2 is a camera configured to capture images of a predetermined volume of space V (under surveillance).

The sensor 2 allows recognizing intrusion into a predetermined zone V (three-dimensional, two-dimensional or one-dimensional) under surveillance, that is, detecting a moving entity in the zone V under surveillance.

According to the invention, the system 100 also comprises a remote control device 5 which can be carried by a user.

It should be noted that the remote control device 5 comprises a base unit configured to be carried by a user.

The base unit may be in any form or shape (bracelet, collar, keyring, etc.).

Alternatively, the remote control 5 may be a tablet, a smartphone or similar electronic device.

It should be noted, therefore, that the remote control device 5 may be a dedicated device, having a battery or being connectable to a processing source, or it may be a smartphone, a tablet or like device.

Preferably, the surveillance device 1 is provided with a data receiving and transmitting module 8 configured to transmit and receive data using electromagnetic waves.

Preferably, the remote control device 5 is provided with a data receiving and transmitting module 6 configured to use electromagnetic waves to transmit data to, and to use electromagnetic waves to receive data from, the data receiving and transmitting module 8 of the surveillance device 1.

According to another aspect, at least one of either the data receiving and transmitting module (6,8) of the surveillance device 1 or of the remote control device 5 is provided with means for adjusting said electromagnetic wave emitting power for setting the emitting power to a predetermined (preset) value.

Also, preferably, at least one of either the data receiving and transmitting module (6,8) of the surveillance device 1 or of the remote control device 5 is configured to transmit the value of said electromagnetic wave emitting power.

This aspect is explained in more detail further on in this description.

According to yet another aspect, the remote control device 5 is provided with a movement sensor 9 for detecting the movement of the self-same device, and is designed to activate (in transmission or receiving mode) the data receiving and transmitting module 6 of the remote control device 5 as a result of the detection of movement by said movement sensor 9.

Preferably, the sensor 9 is an accelerometer or a gyroscope or any other sensor capable of detecting movement.

In the case where the system 100 comprises a plurality of devices 1, it should be noted that each device 1 is, in one embodiment, preferably provided with its own processing means 3 and is therefore independent of the other devices 1.

Advantageously, this distributed electronics structure allows increasing the effectiveness and general reliability of the system, since failure of one of the devices 1 has no impact on the remaining devices, which continue operating perfectly efficiently.

In practice, according to this aspect, information can be exchanged between the different devices 1, making surveillance by the system 100 more efficient and reducing false alarms.

Described below by way of a non-limiting example is a method implemented by the security system 100.

According to the invention, the method for surveillance of a predetermined region V comprises the following steps:

a) preparing at least one surveillance device 1 provided with a sensor 2 configured to detect moving entities in a predetermined region V under surveillance;

b) preparing at least one remote control device 5 which can be carried by a user (authorized to move within the region V under surveillance;

c) detecting a moving entity in the predetermined region V under surveillance, by means of said surveillance device 1;

d) sending, by the surveillance device 1, of a request for authorization;

e) responding, by the remote control device 5, to said request for authorization by sending authorization data;

f) comparing said authorization data with check data for authorizing the entity detected if the result of said comparison is positive;

g) making available an alarm signal if the result of said comparison is negative or inhibiting said alarm signal if the result of said comparison is positive.

It should be noted that, preferably, the step d) of sending, by the surveillance device 1, of a request for authorization is carried out as a result of the detection of a entity (in motion) in the predetermined region V under surveillance by means of said surveillance device 1.

Advantageously, the method implemented by the system 100 allows automatically detecting entities (people, animals or other) entering or moving within the region under surveillance and, fully automatically, authorizing the user which the remote control device 5 is associated with.

It should be noted that obtaining the authorization does not require the user to perform any action (such as, for example, pressing a button or activating a control), thus making the method and the system particularly simple in normal day-to-day use.

In effect, the user the remote control device 5 is associated with does not do anything to authorize their presence in the region V under surveillance.

Moreover, advantageously, the system 100 does not generate a "false alarm" when the user the remote control device 5 is associated with is detected in the authorized region.

According to another aspect, the surveillance method comprises a step of detecting a movement of the remote control device 5 and said step of responding, by the remote control device 5, to said request for authorization by sending authorization data is carried out after the detection of remote control device 5 movement.

Preferably, the movement is detected by means of the sensor 9 associated with the remote control device 5.

More in detail, the movement detected by the movement sensor 9 activates the receiving and transmitting module 6 and places it in a command or information input state (for a predetermined time interval).

The query requests are received by the receiving and transmitting module 6 of the remote control device 5 when the receiving and transmitting module 6 is in the command or information input state.

The command or information input state occurs preferably in "wake on radio" mode, that is to say, the receiving and transmitting module 6 remains in low-power receiving mode (with the receiver off).

The authorization data is transmitted by the receiving and transmitting module 6 preferably in "listen before talk" mode; In other words, the receiving and transmitting module 6 waits for the radio channel to be free before sending the authorization data stored.

It should be noted that this, advantageously, allows reducing the power consumption of the remote control device 5 because, presumably, the user is detected by the device 1, inside the region under surveillance, as a result of a movement and, therefore, generally speaking, it is better to respond to the request for authorization issued by the device 1 only when the user, or rather, the remote control device 5 carried by the user, is subjected to movement.

According to another aspect, preferably, the step of sending, by the surveillance device 1, of a request for authorization comprises a step of transmission of said request for authorization by means of electromagnetic waves (by means of the receiving and transmitting module 8).

Preferably, also, the step of responding, by the remote control device 5, to said request for authorization comprises a step of transmission of said authorization data by means of electromagnetic waves (by means of the receiving and transmitting module 6).

According to this aspect, the step of sending a request for authorization by the surveillance device 1 preferably comprises a step of adjusting the level of said electromagnetic wave emitting power (by the surveillance device 1) to a predetermined level of emitting power.

Further, preferably, the step of sending a request for authorization by the surveillance device 1 also comprises a step of transmitting (by the device 1, and more precisely, by the receiving and transmitting module 8) said predetermined level of said electromagnetic wave emitting power.

That way, advantageously, the information relating to the level of electromagnetic wave emitting power from the device 1 is also transmitted to the remote control device 5.

According to this aspect, preferably, the method comprises a step of measuring, at the remote control device 5

(preferably by means of the remote control device 5 itself) a level of electromagnetic wave receiving power relating to (associated with) the sending of said request for authorization.

Preferably, said measuring step is carried out by the remote control device 5.

Also according to this aspect, preferably, the method comprises a step of comparing the level of electromagnetic wave receiving power relating to the sending of said request for authorization measured (at the remote control device 5) with the level of power transmitted by the surveillance device 1, for estimating the distance between the remote control device 5 and the surveillance device 1.

With reference to this aspect, it should be noted that this allows implementing a technique for measuring the distance between the remote control device 5 and the device 1 with a good degree of reliability.

That way, advantageously, the step of responding, by the remote control device 5, to said request for authorization by sending authorization data is carried out if the estimated distance between the remote control device 5 and the surveillance device 1 is less than a predetermined value, corresponding to a condition of proximity between the remote control device 5 and the surveillance device 1.

That way, advantageously, if the remote control device 5 is too far from the device 1 which transmitted the query data, the device 5 does not transmit any authorization data.

This condition of non-transmission of the authorization data should correspond to an excessive distance of the remote control device 5 from the device 1, which means it is best to inhibit transmission of the authorization data so as to avoid "false alarms".

In short, it should be noted, therefore, that advantageously according to this aspect, if the remote control device 5 receives a query request, it will not respond if it is too far from the device 1 which generated the query.

Advantageously, therefore, this aspect prevents persons who must not be authorized (that is to say, not provided with the remote control device 5) from being authorized by the device 1 by effect of a response sent by a remote control device 5 not in their possession (for example, a remote control device 5 in the possession of another person or located nearby).

This aspect, therefore, allows increasing the overall security of the system.

According to another aspect, the step of responding by the remote control device 5 to the request for authorization comprises a step of adjusting the level of said electromagnetic wave emitting power from the remote control device 5 to a predetermined or calculated level of emitting power.

Also, according to yet another aspect, the step of responding by the remote control device 5 to the request for authorization preferably comprises a step of transmitting the level of said electromagnetic wave emitting power (preferably together with the authorization data).

According to this aspect, the method preferably comprises a step of measuring, at the surveillance device 1 (preferably by means of the surveillance device 1 itself) a level of electromagnetic wave receiving power relating to the authorization data.

Further, according to this aspect, the method comprises a step of comparing the level of electromagnetic wave receiving power relating to said authorization data measured at the surveillance device 1 with the level of the electromagnetic wave power relating to said authorization data sent together with the authorization data by the remote control device 5, for estimating (based on this comparison) a distance between said surveillance device 1 and said remote control device 5.

It should be noted that, according to this aspect, based on this comparison (between the power measured and that transmitted by the remote control device 5 together with the authorization data) the surveillance device 1 is capable of estimating particularly reliably the distance of the remote control device 5 from the surveillance device 1 itself.

That way, advantageously, when the surveillance device 1 is provided with a sensor 2 (for example, a camera) capable of identifying the position of the entity detected inside the zone under surveillance relative to the surveillance device 1 itself, a compatibility check is also carried out to verify the compatibility between the position of the entity detected by the sensor 2 and the distance estimated based on what is described in the foregoing.

If the entity detected is effectively the user in possession of the remote control device 5, the distance estimated based on what is described in the foregoing should correspond to the distance calculated using the position of the entity detected by the sensor 2.

The reliability and security of the system 100 are thus considerably increased.

According to yet another aspect, preferably, the method comprises a step of comparing the estimate of distance between said surveillance device 1 and said remote control device 5 with predetermined values, so as to inhibit an alarm signal associated with the entity detected if said distance estimate is not within said predetermined values.

The purpose of this aspect is to prevent an authorization condition associated with an entity detected by a surveillance device 1 from being created by the remote control device 5 if the latter is at an excessive distance.

It should be noted that the surveillance device 1 receives the authorization data and carries out a comparison with stored check data or information in order to establish an authorization of the entity detected.

In the event of non-reception of authorization following the issuance of the query request or in the event of reception of authorization data which does not allow establishing an authorization following the comparison with the check information, the device 1 makes available (generates) an alarm condition.

This alarm condition expresses an intrusion into the region under surveillance, that is to say, it expresses the presence of a source of potential danger.

With reference to the architecture of the surveillance system 100 when the same is equipped with two or more surveillance devices 1, attention is drawn to the following.

Such surveillance devices 1 may be controlled by a single, central control unit (according to a "star-like" architecture) or each surveillance device 1 may be provided with its own control unit, independent of, but communicating with, those of the others ("peer to peer" architecture).

The control unit is equipped with transmission means for transmitting the alarm signal (via telephone line, cable, wireless network, GSM, etc.).

One advantage of this surveillance system 100 is that the same surveillance device 1 which has detected an entity moving within its own volume of space generates a request for authorization.

If that were not the case, in the event of simultaneous detection of two moving entities, one which should be authorized (because it is in possession of the remote control device 5) and one not authorized, by two distant devices 1 which communicate to the central control unit the detection of the two entities, the central control unit would not be able to correctly understand the authorization of the two entities because it lacks the information regarding the location of the entities.

Under these circumstances, the central control unit might generate an erroneous alarm signal or, in the worst case, might not recognize a situation of potential danger.

According to another aspect, the method comprises a step of measuring at the surveillance device 1, the level of the electromagnetic wave power relating to the authorization data and of comparing this level with a predetermined value.

According to this aspect, if the power of the radio signal received is lower than a predetermined value, an alarm signal associated with the entity detected may be generated.

In effect, such a condition is interpreted as a non-association between the moving entity detected and the remote control device 5 which responded to the query because the remote control device 5 is too far from the surveillance device 1 which detected the entity and it is therefore presumable that the remote control device 5 is outside the region V under surveillance.

In other words, under these conditions, the device 1 recognizes that the moving entity detected is not in possession of the remote control device 5 which emitted the authorization data received (whether or not the data is correct).

According to another aspect, the remote control device 5 is preferably configured to adjust the electromagnetic wave emitting power relating to the authorization data as a function of the indication of the estimated distance (based on the what is described in the foregoing).

This advantageously guarantees optimum reception of the authorization data by the device 1 since the level of power used by the remote control device 5 to transmit the reception data is optimized for the effective distance between the remote control device 5 and the surveillance device 1.

According to another aspect, the remote control device 5 is also preferably configured to transmit, together with the authorization data, also the power level received in the query request (the level transmitted by the surveillance device 1).

It is evident that the method and the system 100 described allow identifying with a high degree of reliability situations of potential intrusion into predetermined regions under surveillance.

Moreover, the method and the system 100 described substantially automatically allow authorized persons to enter the zone under surveillance without it being necessary to switch off the system 100.

A further aspect is that the control device 5 can also be used to detect accidental falls.

This aspect is particularly important for elderly people.

In this regard, the control device 5 is configured to detect a shock and to generate a signal accordingly.

According to yet another aspect, the control device 5 may be provided with a pushbutton to send a remote alarm signal. This is particularly useful to avoid assaults.

The invention described above is susceptible of industrial application. It may be modified and adapted in several ways without thereby departing from the scope of the inventive concept. Moreover, all the details of the invention may be replaced with technically equivalent elements.

The invention claimed is:

1. A method for surveillance of a predetermined region, comprising the following steps:

a) preparing a surveillance device including a sensor configured to detect moving entities in a predetermined region under surveillance;

b) preparing a remote control device which can be carried by a user;

c) detecting a moving entity in the predetermined region under surveillance, via the surveillance device;

d) sending, by the surveillance device, a request for authorization;

e) responding, by the remote control device, to the request for authorization by sending authorization data;

f) comparing the authorization data with check data for authorizing the entity detected if a result of the comparison is positive;

g) making available an alarm signal associated with the moving entity detected if the result of the comparison is negative, or not making available the alarm signal associated with the moving entity detected if the result of the comparison is positive;

estimating a distance between the surveillance device and the remote control device;

comparing the estimate of distance between the surveillance device and the remote control device with predetermined values, for inhibiting the alarm signal associated with the moving entity detected if the estimate of distance is not within the predetermined values.

2. The method according to claim 1, wherein the step d) of sending, by the surveillance device, a request for authorization is carried out as a result of the detecting of the moving entity in the predetermined region under surveillance via the surveillance device.

3. The method according to claim 1, comprising a step of detecting a movement of the remote control device and wherein the step of responding, by the remote control device, to the request for authorization by sending authorization data is carried out after the detecting of the movement of the remote control device.

4. The method according to claim 1, wherein the step of sending, by the surveillance device, the request for authorization comprises a step of transmitting the request for authorization via electromagnetic waves; and wherein the step of responding, by the remote control device, to the request for authorization comprises a step of transmitting the authorization data via electromagnetic waves.

5. The method according to claim 1, wherein the step of sending, by the surveillance device, the request for authorization comprises a step of adjusting a level of electromagnetic wave emitting power of the surveillance device to a predetermined level of electromagnetic wave emitting power and a step of transmitting, substantially simultaneously with the request for authorization, the predetermined level of the electromagnetic wave emitting power.

6. The method according to claim 4, comprising a step of measuring, at the remote control device, a level of electromagnetic wave receiving power relating to the sending, by the surveillance device, the request for authorization, and further comprising a step of comparing the level of electromagnetic wave receiving power relating to the sending, by the surveillance device, the request for authorization measured at the remote control device with a level of electromagnetic wave receiving power transmitted by the surveillance device, for estimating the distance between the surveillance device and the remote control device.

7. The method according to claim 1, wherein the step of responding, by the remote control device, to the request for authorization comprises a step of adjusting a level of electromagnetic wave emitting power from the remote control device to a predetermined level of emitting power and a step of transmitting the predetermined level of the electromagnetic wave emitting power.

8. The method according to claim 7, wherein the step of responding, by the remote control device, to the request for authorization comprises a step of adjusting the level of the electromagnetic wave emitting power from the remote control device as a function of a level of electromagnetic wave receiving power relating to the sending, by the surveillance device, the request for authorization.

9. The method according to claim 1, wherein the step of responding, by the remote control device, to the request for authorization comprises a step of sending together with the authorization data a level of an electromagnetic wave power relating to the request for authorization, received by the remote control device simultaneously with the request for authorization.

10. The method according to claim 1, performing the estimating the distance between the surveillance device and the remote control device by measuring, at the surveillance device, a level of electromagnetic wave receiving power relating to the authorization data.

11. The method according to claim 10, comprising a step of comparing the level of the electromagnetic wave receiving power relating to the authorization data measured at the surveillance device with a level of electromagnetic wave power relating to the authorization data sent together with the authorization data, for estimating the distance between the surveillance device and the remote control device.

12. A surveillance system, configured to monitor a predetermined region under surveillance, comprising:

a surveillance device including a processor and a sensor, configured to detect a moving entity in a predetermined region under surveillance;

a remote control device which can be carried by a user;

wherein the surveillance device is configured to:

detect a moving entity in the predetermined region under surveillance;

send a request for authorization;

wherein the remote control device is configured to:

respond to the request for authorization by sending authorization data;

wherein the surveillance device is further configured to:

compare the authorization data with check data for authorizing the moving entity detected in the predetermined region under surveillance if a result of the comparison is positive;

make available an alarm signal associated with the moving entity detected in the predetermined region under surveillance if the result of the comparison is negative, or not making available the alarm signal associated with the moving entity detected in the predetermined region under surveillance if the result of the comparison is positive;

wherein the remote control device includes:

a data receiving and transmitting module, and a movement sensor for detecting a movement of the remote control device, and wherein the remote control device is configured to activate the data receiving and transmitting module as a result of the detection of the movement by the movement sensor.

13. The surveillance system according to claim 12, wherein the surveillance device includes a data receiving and transmitting module, configured to transmit and receive data using electromagnetic waves, and wherein the data receiving and transmitting module of the remote control device is configured to use electromagnetic waves to transmit data to, and to use electromagnetic waves to receive data from, the data receiving and transmitting module of the surveillance device.

14. The surveillance system according to claim 13, wherein at least one chosen from the data receiving and transmitting module of the surveillance device and the data receiving and transmitting module of the remote control device is configured to adjust an electromagnetic wave emitting power to a predetermined or calculated value, and is also configured to transmit the predetermined or calculated value.

* * * * *